US005167595A

United States Patent [19]

Gleeson et al.

[11] Patent Number: 5,167,595

[45] Date of Patent: Dec. 1, 1992

[54] PLAY APPARATUS HAVING ROTATABLE CLIMBING MEMBER

[75] Inventors: James F. Gleeson, Charlotte; Dana W. Ingold, Salisbury; Mitchell R. Warren, Charlotte, all of N.C.

[73] Assignee: Restaurant Technology, Inc., Ock Brook, Ill.

[21] Appl. No.: 845,301

[22] Filed: Mar. 3, 1992

[51] Int. Cl.[5] ..... A63B 9/00

[52] U.S. Cl. ..... 482/35; 482/78

[58] Field of Search ..... 482/35, 48, 78; 119/29; 446/901; 472/16, 30

[56] References Cited

U.S. PATENT DOCUMENTS

D 219,603 12/1970 Wormser ..... D34/5
D. 244,556 5/1977 Burgess et al. ..... D34/5 H
883,485 3/1908 Ridgway ..... 119/29
3,933,126 1/1976 Gordon ..... 119/29
4,629,182 12/1986 Rader ..... 272/113
4,988,090 1/1991 Schmitt ..... 482/35

*Primary Examiner*—Stephen R. Crow
*Attorney, Agent, or Firm*—Jenner & Block

[57] ABSTRACT

An article of play apparatus is provided having an open-ended, hollow rotatable member which is maintained in an elevated, horizontal orientation by two support members located one at each longitudinal end of the rotatable member. A plurality of padded ridges extend along the longitudinal extent of the rotatable member. In this manner, children can climb through the rotatable member while other children climb over it, causing the rotatable member to rotate. A novel bearing system is housed inside each support member.

8 Claims, 2 Drawing Sheets

FIG-1
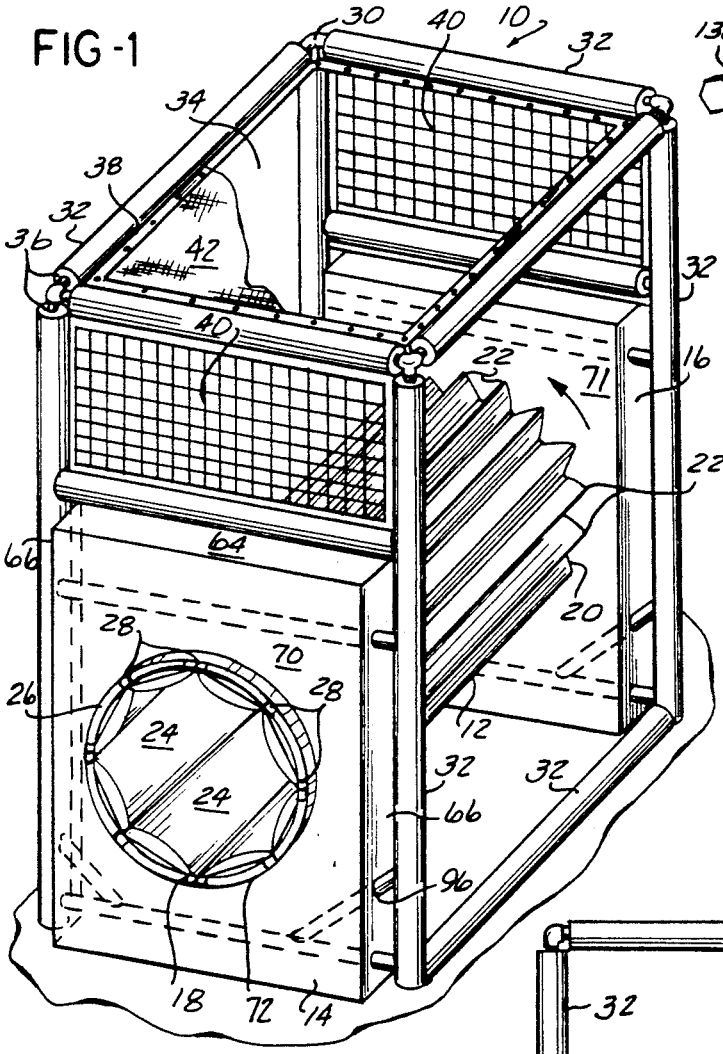
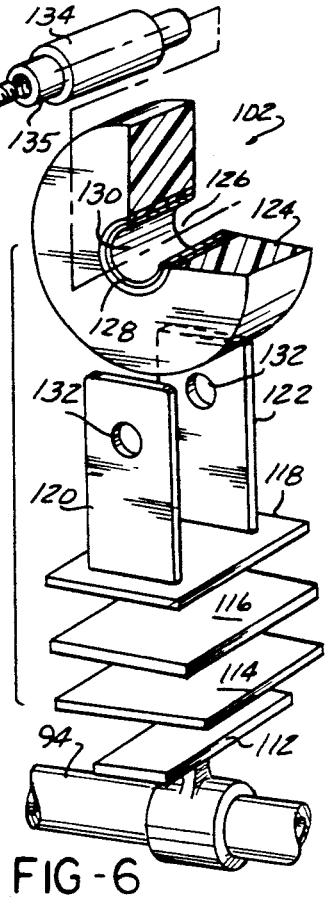
FIG-6
FIG-7
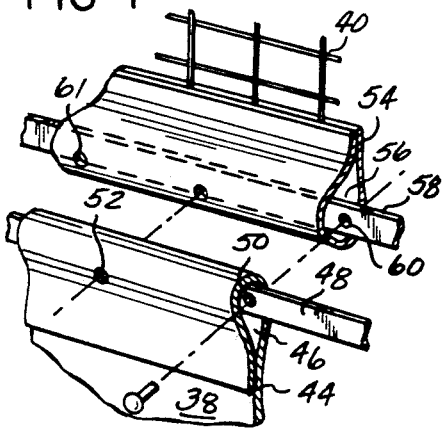
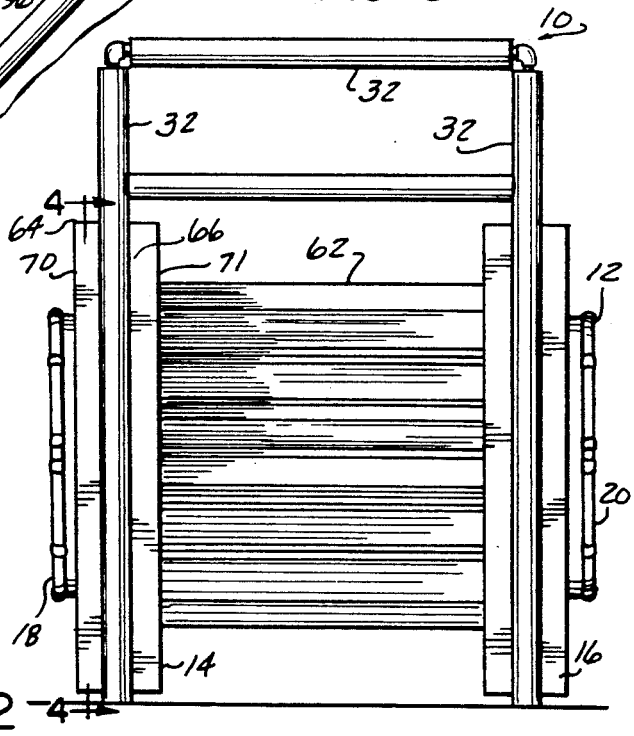
FIG-2

PLAY APPARATUS HAVING ROTATABLE CLIMBING MEMBER

FIELD OF THE INVENTION

This invention relates to apparatus particularly suited for recreational use by children. In particular, the invention relates to children's climbers.

BACKGROUND OF THE INVENTION

While children's play equipment has been around for decades, many parents are unaware of the fundamental role playing has in a child's physical, mental and social development. Generally, play equipment, such as well-known playground slides and monkey bars, does not offer the fullest opportunity for children to develop. Moreover, some prior art provided limited protection in the event of a fall. In particular, there is a need for play equipment that allows children to practice climbing and balance skills, while safely taking risks. Specifically, there is a need for play equipment that minimizes risk of injury to children playing thereon.

SUMMARY OF THE INVENTION

In accordance with the invention, play apparatus is disclosed which provides children, and particularly small children, with safe, challenging play by which the children can develop their imaginations, self-confidence, physical strength, agility, and social skills. In accordance with the invention, passive safety structures are also incorporated into the design of the play apparatus.

In a preferred embodiment, the play apparatus has an open-ended hollow member into which children may crawl into. Preferably, the hollow member is a cylinder or tube. The tube is rotatably mounted on two supports at each of its longitudinal ends so that the tube is horizontally oriented and somewhat elevated. Padded ridges run longitudinally around the outside surface of the tube. The padded ridges allow children to climb over the outside of the tube while other children crawl through the inside. As children climb over the tube, they cause the tube to rotate.

The two support members at each longitudinal end of the rotating tube have holes which receive the ends of the tube. Inside each of the support members, a novel bearing is housed which allows one-way rotation of the tube when the tube's ends are disposed in the holes. The novel bearing comprises a plurality of caster wheels which peripherally engage the rotating tube. One of the casters is equipped with a one-way clutch for permitting rotation of the tube in one direction only.

In some cases, a frame formed of horizontal and vertical frame members forms a box-like closure around the tube and supports. Nets may be strung between the frame members to partially enclose the tube. Additionally, a net or tarpaulin-like cover may be suspended over the tube by the frame members to prevent children from crawling on top of the frame.

BRIEF DESCRIPTION OF THE DRAWINGS

FIG. 1 is a perspective view of play apparatus that embodies the invention;

FIG. 2 is a side elevation view of the play apparatus shown in FIG. 1;

FIG. 6 is an exploded perspective view of one of the caster bearings that is housed in the support member shown in FIG. 4; and FIG. 7 is an exploded perspective view of grommet-bearing flanges that are part of the play apparatus shown in FIG. 1.

DETAILED DESCRIPTION OF THE PREFERRED EMBODIMENTS

Figure 3:
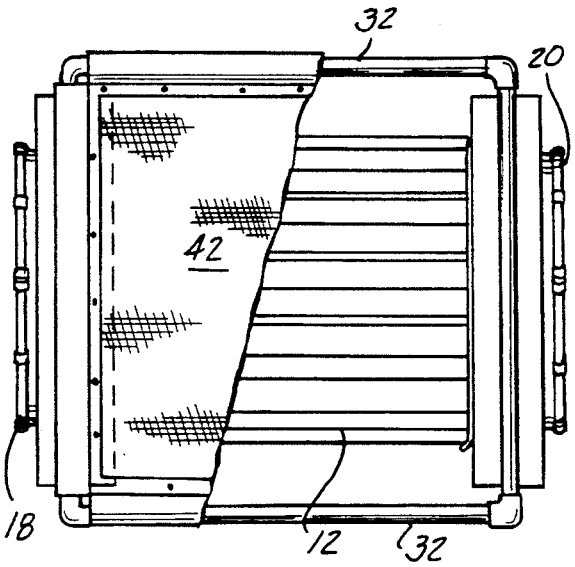
FIG. 3 is a top, partial cut-away view of the play apparatus shown in FIG. 1.

Referring to FIGS. 1 and 2, in accordance with the present invention, play apparatus 10 is provided having a rotatable member 12 which is rotatably mounted to supports 14 and 16 located at longitudinal ends 18 and 20 of rotatable member 12. Rotatable member 12 is preferably a horizontally-oriented, hollow cylinder or tube such as a plastic drainage pipe used in sewer construction. Rotatable member 12 is open at one or both longitudinal ends 18 and 20, and has a inside diameter of about 33 inches. Rotatable member 12 preferably has an interior diameter of sufficient length to allow children to crawl therethrough. A suitable diameter is thirty inches. A plurality of ridges 22 extend along the longitudinal extent of rotatable member 12, and may be formed of dense foam pads having a triangular shape cross section and being suitably mounted to the exterior of rotatable member 12. Ridges 22 are covered with a vinyl jacket for improved longevity and esthetics.

The interior of rotatable member 12 is suitably padded by foam sections 24, and is covered with a vinyl sleeve 26. The longitudinal ends of vinyl sleeve may be folded over the longitudinal ends 18 and 20 of rotatable member 12 and secured thereto by rivets (not shown) through nylon tabs 28, or by any other suitable devices.

It will be observed that rotatable member 12 is especially adapted for recreational use by children, who can enter rotatable member 12 through either of longitudinal ends 18 and 20, and can crawl over rotatable member 12 using ridges 22 as hand and footholds. It has been found that the action of children climbing over rotatable member 12 while other children are inside rotatable member 12 promotes a developmentally stimulating social interaction between children. Also, the effort required to climb over rotatable member 12 develops physical qualities in children such as strength and agility, and builds self-confidence. Children inside rotatable member 12 enjoy the tumbling sensation and develop a sense of spatial awareness.

As described below, rotatable member may adopted for rotatable movement in one direction, as indicated by the arrow in FIG. 1. The advantage to limiting the rotation of rotatable member 12 to only one direction is related to the fact that play apparatus 10 may be used in conjunction with other play apparatus as part of a path or course through which children progress. By allowing rotatable member 12 to only rotate in one direction, children are encouraged to move over play apparatus 10 in a single direction. Thus, the flow of children along the path or course is facilitated. Also, as a safety feature, it is desirable that children not be attempting to rotate rotatable member 12 in different directions at the same time, as such action could result in a child being thrown backwards from rotatable member 12.

Play apparatus 10 may includes a frame 30, which is comprised of vertical and horizontal frame members 32 connected together to define a box-like interior region 34 in which rotatable member 12 is disposed. Frame members 32 may be conventional two-inch metal pipes which are clamped together by suitable clamps. Alternatively, frame members could be constructed of other materials and/or welded or otherwise joined together. For clarity, it should be noted that not every frame member 30 illustrated in the Figures is indicated by a reference numeral. Frame members 32 are preferably covered by jackets 36 of foam padding (preferably of polyethylene). As is conventional, jackets 36 have a longitudinal slit (not shown) which enables them to be placed around frame members 32. Jackets 36 may be secured to frame members 32 with electrical ties or other suitable fasteners (not shown). Jackets 36 may be covered by vinyl sleeves 38.

A plurality of nets 40 are provided. Nets 40 may be strung in any suitable fashion between frame members 32 to partially enclose interior region 34. Nets 40 are a safety feature which prevents children from crawling over the top of supports 14 and 16. Nets 40 may be made of any suitable material such as cotton or nylon. Alternatively, a mesh or other fabric may be used in place of nets 40. A net grid size of two-by-two inches may be used. A top cover 42 which may be a net or tarpaulin-like material is provided as an additional safety feature. Top cover 42 is suspended over rotatable member 12 by frame members 32 to prevent children standing on rotatable member 12 from crawling on top of frame 30. Additionally, a mat (not shown) is preferably placed under and next to rotatable member 12 to cushion the falls of children crawling thereover.

In connecting nets 40 to frame members 32, a variety of known techniques may be used. For example, the edges of nets by be provided with a grommet-bearing flange. A line or cord can be laced through the grommets and around one of frame members 32. It will be noted that the longitudinal slits of jackets 36 can be used to accommodate the line or cord connecting the nets 40 with the frame members 32.

Another technique for fastening nets 40 to frame members 32 is illustrated in FIG. 7. Grommet-bearing flanges 44 are suitably attached, such as by stitching, along the longitudinal extent of vinyl sleeves 38. Flanges 44 are of pliable material such as vinyl, and the upper portion of each of flanges 44 is folded over and sewn or sealed to provide an elongated sleeve 46 in which a thin, elongated aluminum extrusion 48 is inserted. The extrusion 48 has a plurality of apertures 50 spaced at intervals along its longitudinal extent, and which are aligned with grommets 52 of flanges 44. In accordance with the technique illustrated in FIG. 7, each of nets is equipped with a similar grommet-bearing flange or edge 54. Edge 54 includes a sleeve 56 into which a second extrusion 58 is inserted. Second extrusion 58 has a plurality of apertures 60 which are alignable with grommets 61 of edge 54 and also with the apertures 50 of extrusion 48. Flange 32 is secured to nets 40 by aligning apertures 50 and 60 and grommets 52 and 61, and inserting therethrough rivets or other suitable fasteners as shown in FIG. 7.

Turning back to FIGS. 1, 2, and 3, each of supports 14 and 16 is of substantially identical construction, and supports rotatable member 12 in a horizontal, slightly elevated position. Preferably, two supports 14 and 10 are used, one at each one of longitudinal ends 18 and 20. However, other constructions are possible. For example, a single support could be used if it were located near a middle portion 62 (see FIG. 2) of rotatable member 12.

Each support 14 and 16 is a thin rectangular box having a top 64, thin lateral sidewalls 66 and 68, and substantially planar front and rear faces 70 and 71, respectively. Each support 14 and 16 is constructed of any suitable material, such as plywood, and may have overall dimensions such as approximately forty-five inches high, forty-five inches wide and nine inches deep. Front and rear faces 70 and 71 of supports 14 and 16 have holes which define a large central aperture 72 for receiving one of longitudinal ends 18 and 20 of rotatable member 12 when rotatable member is horizontally oriented. A bearing 74 is disposed in each support member 14 and 16 for peripherally engaging one of longitudinal ends 18 and 20 to allow rotation of rotatable member 12 about its own longitudinal axis when that one of longitudinal ends 18 and 20 is journaled in central aperture 72.

Figure 4:
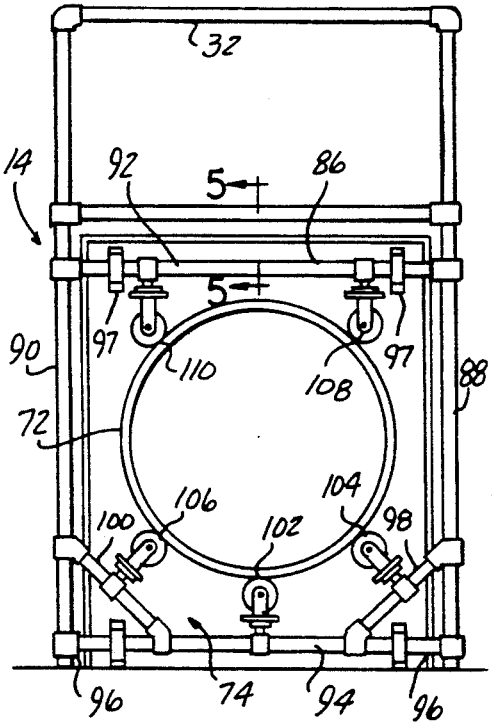
FIG. 4 is a sectional view of a support member that is a part of the play apparatus shown in FIG. 2, taken along the lines 4—4.
Figure 5:
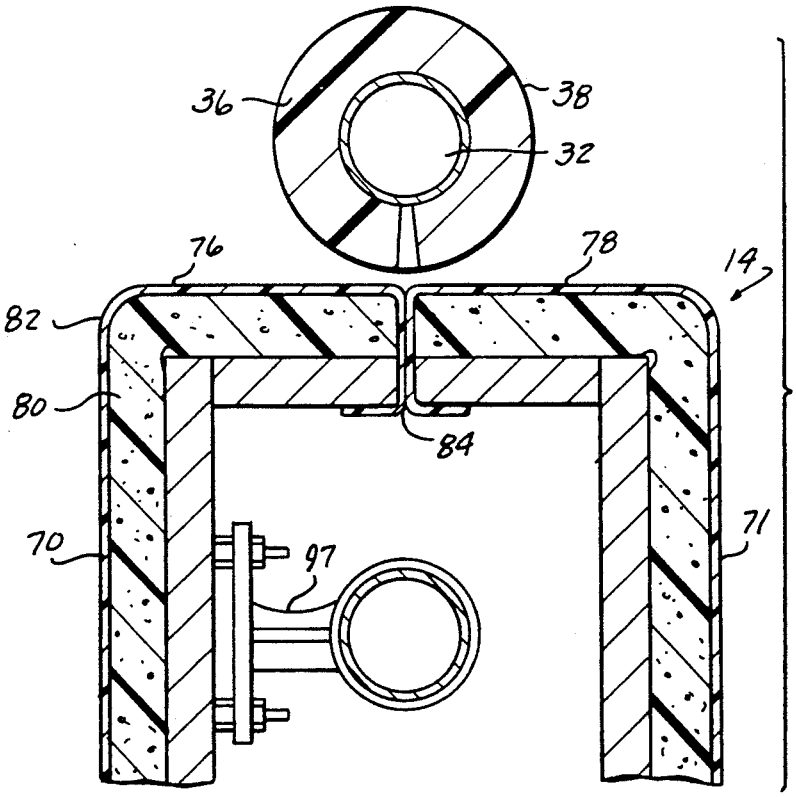
FIG. 5 is a sectional view of a support member that is part of the play apparatus shown in FIG. 4 taken along the lines 5—5.

Referring to FIGS. 4 and 5, the construction and internal operation of supports 14 and 16 is illustrated. Because supports 14 and 16 are substantially identical, only support 14 is illustrated in FIGS. 4 and 5. For convenience in assembly, support 14 is formed of a front half 76 and rear half 78 which are then suitably fastened together (as best seen in FIG. 5). Support 14 is covered with padding 80 such as one inch of foam and then enclosed in a vinyl jacket 82. The edges of vinyl jacket 82 may be tucked in along a joint 84 formed between front and rear halves 76 and 78 of support 14, and then stapled or otherwise suitably fastened to the inside surface of support 14, as best seen in FIG. 5.

The top 64 and sides 66 and 68 of support 14 are framed by frame members 86, 88 and 90, respectively. First and second internal horizontal crossbars 92 and 94 penetrate support 14 through apertures 96 located in the sidewalls 66 and 68, respectively. First internal crossbar 92 is located a few inches above large central aperture 72, and second internal crossbar 94 is located approximately seven inches below large central aperture 72, as best seen in FIG. 4. First and second internal crossbars 92 and 94 may be clamped to frame members 88 and 90 in any suitable manner, and each is mounted to the interior side of front face 70 by a plurality of spaced-apart conventional brackets 97.

Third and forth internal crossbars 98 and 100 are also provided, and descend diagonally from a lower portion of vertical frame members 88 and 90, respectively. Each of third and fourth internal crossbars 98 and 100 is connected at a lower end to second internal crossbar 94.

As best seen in FIG. 5, bearing 74 is comprised of a plurality (preferably five) hard roller casters 102, 104, 106, 108 and 110 mounted to first, second, third and forth internal crossbars for peripheral engagement of longitudinal end 18. Caster 102 is located on second crossbar 94 and is in central alignment with rotatable member 12 for bearing a substantial component of the weight of rotatable member 12. Casters 104 and 106 are mounted to third and fourth crossbars 98 and 100, respectively, and also absorb a component of the weight of rotatable member 12. Casters 106 and 108 are mounted to first crossbar 92, and are each positioned near one of opposing sidewalls 66 and 68, respectively, for bearing other forces imparted onto rotatable member 12. It will be noted that casters 102, 104, 106, 108 and 110 are spaced at ninety degree intervals around the perimeter of the cross section of rotatable member 12.

Bearing 74 is rugged, reliable and inexpensive to manufacture. An additional advantage of bearing 74 is that its component casters are standard, commercially available parts. Moreover bearing 74 can be easily adjusted, as discussed below. Referring to FIG. 6, caster 102 is illustrated. Except as specifically mentioned below, caster 102 is substantially identical in construction to the other casters 104, 106, 108 and 110 (shown in FIG. 4). A caster clamp 112 connects a first base 114 to a crossbar, such as second internal crossbar 94. A second base 116 is suitably connected (such as by welding) in turn to a first base 114, which is connected to a roller mount 118.

Roller mount 118 includes two flanges 120 and 122 in spaced parallel relation for receiving a roller 124 therebetween. Roller 124 has a central bore 126 into which a bushing 128 is securely inserted such as with a force fit. In the case of roller clutch caster 102, bushing 128 is equipped with a roller clutch 130 for permitting roller 124 to rotate in only one direction. In the cases of the other casters 104, 106, 108 and 110, bushing 128 is simply equipped with a suitable roller bearing (not shown). Suitable roller bearings and clutches are commercially available, such as the Model RCB-121616 from the Torrington Company of Torrington, CT.

Flanges 120 and 122 each include an aperture 132 for receiving one of the longitudinal ends of an axle 134 which is inserted through brushing 130 (and central bore 128). The longitudinal journal ends 135 of axle 134 are threaded to receive securing bolts 136, which secure axle 134 to roller mount 118.

It will be noted that the orientation of each one of casters 102, 104, 106, 108 and 110 is such that each caster's respective roller has an axis of rotation that is parallel to the axis of rotation of rotatable member 12. Moreover, by adjusting the positions of casters 102–110 along their respective internal crossbars 92, 94, 98 and 100, it is possible to adjust the compression force exerted by the casters on the perimeter of rotatable member 12. By reducing or increasing this force, rotation of rotatable member 12 can be made harder or easier. Preferably, rotatable member 12 should not rotate too easily, as excessive rotational speed may cause injury to children.

While the invention has been described herein with respect to certain preferred embodiments, it is to be understood that the invention is capable of numerous changes, modifications and rearrangements without departing from the invention as defined in the claims.

What is claimed is:

1. Play apparatus, comprising:

a hollow member having an interior width sufficiently large to allow children to crawl therethrough and having first and second longitudinal ends defining a longitudinal axis therebetween, at least one of said first and second longitudinal ends being open;

a plurality of padded ridges extending along the longitudinal extent of the exterior of said hollow member;

a first support member having an aperture therethrough for receiving one of said first and second longitudinal ends of said hollow member when said hollow member is in a horizontal orientation; and bearing means disposed in said first support member for peripherally engaging said hollow member to allow rotation of said hollow member about said hollow member's longitudinal axis when said hollow member is disposed in said aperture;

wherein said hollow member is rotatably disposed in said aperture of said first support member.

2. The play apparatus according to claim 1 further comprising:

a second support member having an aperture therethrough for receiving one of said first and second longitudinal ends of said hollow member when said hollow member is in a horizontal orientation; and second bearing means disposed in said second support member for peripherally engaging said hollow member to allow rotation of said hollow member about said hollow member's longitudinal axis when said hollow member is disposed in said aperture of said second support member;

wherein one of said longitudinal ends of said hollow member is rotatably disposed in said first support member, and the other of said longitudinal ends is rotatably disposed in said second support member.

3. The play apparatus according to claim 1 wherein said first support member further comprises a net and a frame extending upward from said first support member, said frame having means for mounting said net therein, and said net being mounted in said frame by said mounting means.

4. The play apparatus according to claim 3 further comprising means for fastening objects having aligned apertures; and wherein said mounting means comprises a first flange extending from said frame and a second flange extending from said net, said first and second flanges each comprising:

a plurality of spaced apart grommets extending along said first and second flanges' respective longitudinal extents;

first and second elongated brackets having a plurality of spaced apart apertures along its longitudinal extent, said bracket being fitted to said first and second flanges so that said bracket apertures are aligned with said flange apertures;

wherein said first and second flanges are juxtaposed for aligning each of their respective grommets and bracket apertures, and wherein said aligned grommets and bracket apertures are fastened by said fastening means.

5. The play apparatus according to claim 1 wherein said first and second longitudinal ends are cylindrical in shape.

6. The play apparatus according to claim 5 wherein said bearing means comprises a plurality of caster wheels;

means for mounting said plurality of caster wheels in spaced-apart, peripheral engagement with said rotatable member;

wherein each of said caster wheels is mounted with its axis of rotation generally parallel to the longitudinal axis of said rotatable member.

7. The play apparatus according to claim 6 wherein said plurality of caster wheels includes at least one caster is adapted for rotation in a single direction.

8. The play equipment according to claim 1 wherein the interior width of said hollow member is between twenty-four and forty-eight inches.

* * * * *